US012765704B1

(12) United States Patent
Shao

(10) Patent No.: US 12,765,704 B1
(45) Date of Patent: Oct. 20, 2026

(54) DYNAMIC CHRISTMAS TREE

(71) Applicant: Shu-Fa Shao, New Taipei City (TW)

(72) Inventor: Shu-Fa Shao, New Taipei City (TW)

( * ) Notice: Subject to any disclaimer, the term of this patent is extended or adjusted under 35 U.S.C. 154(b) by 0 days.

(21) Appl. No.: 19/539,829

(22) Filed: Feb. 13, 2026

(30) Foreign Application Priority Data

Jan. 23, 2026 (CN) ..... 202610097318.9

(51) Int. Cl.
*A47G 33/06* (2006.01)
*A41G 1/00* (2006.01)
*A47G 33/12* (2006.01)

(52) U.S. Cl.
CPC ..... *A47G 33/06* (2013.01); *A41G 1/007* (2013.01); *A47G 33/126* (2013.01)

(58) Field of Classification Search
CPC ..... A47G 33/06; A47G 33/126; A41G 1/007
USPC ..... 248/521, 522, 526
See application file for complete search history.

(56) References Cited

U.S. PATENT DOCUMENTS 1,711,790 A 5/1929 Johnson
2,279,182 A * 4/1942 Snyder ..... A47G 33/126 248/521
2,956,357 A * 10/1960 Rakes ..... A47G 33/126 40/457
3,681,589 A * 8/1972 Roberts ..... F21S 4/20 362/253
3,970,834 A * 7/1976 Smith ..... A47G 33/06 362/123
4,428,988 A * 1/1984 Adinamis ..... F21S 8/00 428/20
4,858,086 A * 8/1989 Pietrantonio ..... G02B 6/0005 428/10
5,647,569 A * 7/1997 Sofy ..... A47G 33/126 248/522
5,979,859 A * 11/1999 Vartanov ..... F16M 11/08 248/522
6,053,798 A * 4/2000 Tang ..... A47G 33/06 446/342
6,422,915 B1 * 7/2002 Chen ..... A63H 33/00 446/175
6,679,622 B1 * 1/2004 Kao ..... A41G 1/005 362/567
6,739,746 B1 * 5/2004 Tang ..... A47G 33/06 362/567
7,267,852 B1 * 9/2007 Rosado ..... A47G 33/06 428/20
8,100,546 B2 * 1/2012 Lutz ..... A47G 33/06 40/414
8,848,948 B1 * 9/2014 Daniels ..... A47G 33/126 381/124

(Continued)

*Primary Examiner* — Muhammad Ijaz
(74) *Attorney, Agent, or Firm* — United One Law Group LLC; Kongsik Kim; Jhongwoo Peck

(57) ABSTRACT

The present disclosure discloses a dynamic Christmas tree, including a main rod, a first branch rod, and a turntable assembly. The main rod includes a top and a bottom. An active layer exists between the top and the bottom. The first branch rod is connected to the main rod and located at the active layer. The turntable assembly has a first actuating portion. The turntable assembly is annularly fixed to the main rod, and the first actuating portion extends toward the first branch rod. The turntable assembly is configured to: when being actuated, drive the first actuating portion to move around the main rod, to intermittently push the first branch rod to swing relative to the main rod.

20 Claims, 11 Drawing Sheets

(56) References Cited

U.S. PATENT DOCUMENTS 8,993,077 B2 * 3/2015 Schooley ..... A47G 33/06 428/18
9,040,130 B2 * 5/2015 Schooley ..... A47G 33/06 428/18
11,517,933 B2 12/2022 Laforce
11,525,565 B1 * 12/2022 Liu ..... F21V 33/0028
11,641,968 B1 * 5/2023 Zou ..... A47G 33/06 362/249.14
11,793,342 B1 * 10/2023 Hall ..... A47G 33/06
12,137,828 B1 * 11/2024 Stout ..... A47G 33/12
12,320,508 B1 * 6/2025 Stout ..... A47G 33/06
12,507,822 B2 * 12/2025 Cai ..... A47G 33/06
2004/0090770 A1 * 5/2004 Primeau ..... A47G 33/06 362/249.18
2004/0097165 A1 * 5/2004 Wong ..... A63H 33/00 446/320
2005/0048226 A1 * 3/2005 Gary ..... A47G 33/06 428/18
2006/0145044 A1 * 7/2006 Wang ..... F16M 11/28 248/422
2007/0092664 A1 * 4/2007 Chun ..... A47G 33/06 428/18
2011/0211364 A1 * 9/2011 Lutz ..... A47G 33/06 362/555
2012/0008313 A1 * 1/2012 Plumb ..... G09F 19/02 362/184
2014/0268688 A1 * 9/2014 Yang ..... A47G 33/06 362/123
2017/0196391 A1 * 7/2017 Schooley ..... A47G 33/06
2017/0256898 A1 * 9/2017 Ocegueda Gallaga ..... A47G 33/06
2017/0340156 A1 * 11/2017 Ocegueda Gallaga ..... A47G 33/06
2018/0028009 A1 * 2/2018 Ocegueda Gallaga ..... A47G 33/06
2018/0289195 A1 * 10/2018 Zhao ..... A47G 33/06
2019/0320837 A1 * 10/2019 Tsai ..... A47G 33/06
2020/0397174 A1 * 12/2020 McRae ..... F21V 23/04
2021/0033249 A1 * 2/2021 McRae ..... F21L 4/08
2022/0399757 A1 * 12/2022 Szweda ..... A47G 33/06
2023/0225537 A1 * 7/2023 Johnson ..... A47G 33/06 428/7
2024/0186835 A1 * 6/2024 Szweda ..... H02J 7/02
2024/0341503 A1 * 10/2024 Lin ..... A47G 33/06
2025/0031891 A1 * 1/2025 Xu ..... A47G 33/06
2025/0049244 A1 * 2/2025 Cai ..... A47G 33/06
2025/0081315 A1 * 3/2025 Cai ..... A47G 33/06
2025/0204712 A1 * 6/2025 Zou ..... A47G 33/126
2025/0311872 A1 * 10/2025 Cai ..... A47G 33/06
2025/0325134 A1 * 10/2025 Pas ..... A47G 33/06
2025/0359696 A1 * 11/2025 Li ..... A47G 33/126
2025/0366648 A1 * 12/2025 Cai ..... A47G 33/06

* cited by examiner

DYNAMIC CHRISTMAS TREE

CROSS-REFERENCE TO RELATED APPLICATION

This application claims priority from Chinese Application No. 202610097318.9 filed on Jan. 23, 2026, which is incorporated herein by reference in its entirety.

BACKGROUND

1. Technical Field

This application relates to a dynamic Christmas tree, and in particular, a dynamic Christmas tree that can control swing of branches and/or a lighting effect of the Christmas tree.

2. Related Art

Internationally, there is a festive tradition of displaying Christmas trees during Christmas celebrations, and people decorate Christmas trees. Currently, decorations for Christmas trees only involve hanging ornaments on the branches or winding light strings around the branches. However, these decorations provide only static visual effects, and currently, Christmas trees are unable to achieve dynamic visual effects. Some people place the base of a Christmas tree on a turntable for rotation, but this rotation effect is monotonous. Moreover, when the height of the Christmas tree exceeds one meter, rotating it from the base can easily cause the Christmas tree to tip over.

SUMMARY

In view of this, a dynamic Christmas tree is provided. The dynamic Christmas tree includes a main rod, a first branch rod, and a turntable assembly. The main rod includes a top and a bottom. An active layer exists between the top and the bottom. The first branch rod is connected to the main rod and located at the active layer. The turntable assembly has a first actuating portion. The turntable assembly is annularly fixed to the main rod, and the first actuating portion extends toward the first branch rod. The turntable assembly is configured to: when being actuated, drive the first actuating portion to move around the main rod, to intermittently push the first branch rod to swing relative to the main rod.

In some embodiments, the dynamic Christmas tree further includes a second branch rod and a connection line. The second branch rod is connected to the main rod and located on a driven layer between the active layer and the bottom. One end of the connection line is connected to the second branch rod, and the other end of the connection line is connected to one of the first branch rod and the turntable assembly, and the connection line is located outside the turntable assembly. The turntable assembly drives the second branch rod via the connection line.

In some embodiments, the dynamic Christmas tree further includes a controller. The controller is configured to generate a drive signal, and the turntable assembly is actuated according to the drive signal.

In some embodiments, the turntable assembly includes a fixed disk, a turntable, and a drive assembly. The fixed disk has a central shaft hole, and the central shaft hole is annularly fixed to the main rod. The turntable is movably connected to the fixed disk. The turntable has an upper surface and a side surface, and the first actuating portion is located on the upper surface. The drive assembly is configured to drive, according to the drive signal, the turntable to rotate relative to the main rod.

In some embodiments, an inner edge of the side surface has an annular tooth portion. An accommodating portion is provided between the turntable and the fixed disk, and the drive assembly is disposed in the accommodating portion. The drive assembly includes a driven gear and a motor unit. The driven gear meshes with the annular tooth portion, and the motor unit is configured to drive the driven gear according to the drive signal.

In some embodiments, the side surface has an annular tooth portion, and the drive assembly is disposed on the fixed disk. The drive assembly includes a driven gear and a motor unit, the driven gear meshes with the annular tooth portion, and the motor unit is configured to drive the driven gear according to the drive signal.

In some embodiments, the turntable assembly further has a second actuating portion, the second actuating portion extends toward the connection line, and the first actuating portion and the second actuating portion are staggered at a peripheral position of the turntable assembly; where the turntable has an upper surface and a side surface, and the second actuating portion is located on the side surface.

In some embodiments, the upper surface has a first light-emitting unit, and the first light-emitting unit is configured to generate first light oriented to the top according to the drive signal. The fixed disk has a second light-emitting unit, and the second light-emitting unit is configured to generate second light oriented to the bottom according to the drive signal.

In some embodiments, the dynamic Christmas tree further includes a clasp member. Two ends of the clasp member respectively have a clasp portion and an abutment portion. The clasp portion clasps the first branch rod, the abutment portion normally abuts against the upper surface, and the abutment portion is located on a moving track of the first actuating portion.

In some embodiments, the turntable assembly further includes a top cover, and the top cover covers the turntable. The top cover has a through-hole, the through-hole and the clasp member correspond to a plumb line, the clasp member extends into the through-hole, and the top cover, the fixed disk, and the turntable are separated from or assembled to the main rod according to the central shaft hole.

In some embodiments, the dynamic Christmas tree further includes a connecting rod. The connecting rod is disposed at the active layer. The connecting rod has a fixed segment and a movable segment, one end of the fixed segment being connected to the main rod, one end of the movable segment being pivotally connected to the other end of the fixed segment, and the first branch rod being connected to the other end of the movable segment.

In some embodiments, the dynamic Christmas tree further includes a rotational connection assembly and a top rod. One end of the rotational connection assembly is connected to the top of the main rod. The top rod is connected to the other end of the rotational connection assembly. The rotational connection assembly is configured to rotate the top rod according to the drive signal.

In some embodiments, the rotational connection assembly includes a base, a rotor, and a motor. The base is connected to the top of the main rod. One end of the rotor is connected to the base, and the other end of the rotor is connected to the top rod. The motor is connected to the base, and is configured to drive the rotor to rotate according to the drive signal.

In some embodiments, the rotor includes a connecting sleeve, and the connecting sleeve is sleeved on a rotating shaft of the motor, so that the rotating shaft drives the rotor to rotate; where the connecting sleeve further includes a guide opening, and the guide opening is configured to guide the rotor into the connecting sleeve.

In some embodiments, the rotational connection assembly further includes a bearing and a connection bracket. The bearing is pivotally disposed on the motor and has two first electrodes, two second electrodes of the base surrounding the bearing and being respectively electrically connected to the two first electrodes. The connection bracket is located between the base and the rotor and surrounds the motor. One side of the rotor has an electrical connection terminal, one side of the connection bracket has an electrical connection socket, the electrical connection terminal is connected to the electrical connection socket, and the electrical connection socket is electrically connected to the two first electrodes, so as to drive the rotor and the connection bracket to rotate synchronously.

In some embodiments, the dynamic Christmas tree further includes a first light-emitting unit and a second light-emitting unit; the first light-emitting unit, the second light-emitting unit, the motor, the drive assembly, and the controller being respectively connected by two wires to form a control circuit. The first light-emitting unit and the second light-emitting unit each have a lighting drive chip, the lighting drive chip being configured to selectively drive the first light-emitting unit and the second light-emitting unit according to the drive signal.

In some embodiments, the main rod is assembled from a first rod body and a second rod body, the first rod body and the second rod body each having the active layer and the driven layer. The dynamic Christmas tree further includes a rotational connection assembly. One end of the rotational connection assembly is connected to the bottom of the first rod body, and the other end of the rotational connection assembly is connected to the top of the second rod body, the rotational connection assembly being configured to rotate the first rod body according to the drive signal.

In some embodiments, the rotational connection assembly further includes a base, a rotor, and a motor. The base is connected to the top of the main rod. One end of the rotor is connected to the base, and the other end of the rotor is connected to the bottom of the first rod body. The motor is connected to the base, and is configured to drive the rotor to rotate according to the drive signal.

In some embodiments, the rotational connection assembly further includes a bearing and a connection bracket. The bearing is pivotally disposed on the motor and has two first electrodes, two second electrodes of the base surrounding the bearing and being respectively electrically connected to the two first electrodes. The connection bracket is located between the base and the rotor and surrounds the motor. One side of the rotor has an electrical connection terminal, one side of the connection bracket has an electrical connection socket, the electrical connection terminal is connected to the electrical connection socket, and the electrical connection socket is electrically connected to the two first electrodes, so as to drive the rotor and the connection bracket to rotate synchronously.

In some embodiments, the dynamic Christmas tree further includes a first light-emitting unit and a second light-emitting unit; the first light-emitting unit, the second light-emitting unit, the motor, the drive assembly, and the controller being respectively connected by two wires to form a control circuit. The first light-emitting unit and the second light-emitting unit each have a lighting drive chip, the lighting drive chip being configured to selectively drive the first light-emitting unit and the second light-emitting unit according to the drive signal. The dynamic Christmas tree further includes a tilt sensor, configured to, when sensing that the main rod tilts, send a warning signal, and the controller stops sending the drive signal according to the warning signal.

In conclusion, in the dynamic Christmas tree in some embodiments, rotation of the turntable assembly is controlled, to directly or indirectly drive the first branch rod and the second branch rod to swing. In this way, a swing sequence of the first branch rod and the second branch rod can be further controlled according to a movement stroke or a rotational speed of the turntable assembly. Under coordination of swinging of the branch rods and the lighting, a dynamic effect simulating branches being blown by the wind is created, so as to meet a user's demand for dynamic effects such as swinging and illumination of the Christmas tree.

The following describes the present disclosure in detail with reference to the accompanying drawings and specific embodiments, but is not intended to limit the present disclosure.

DETAILED DESCRIPTION

Figure 1:
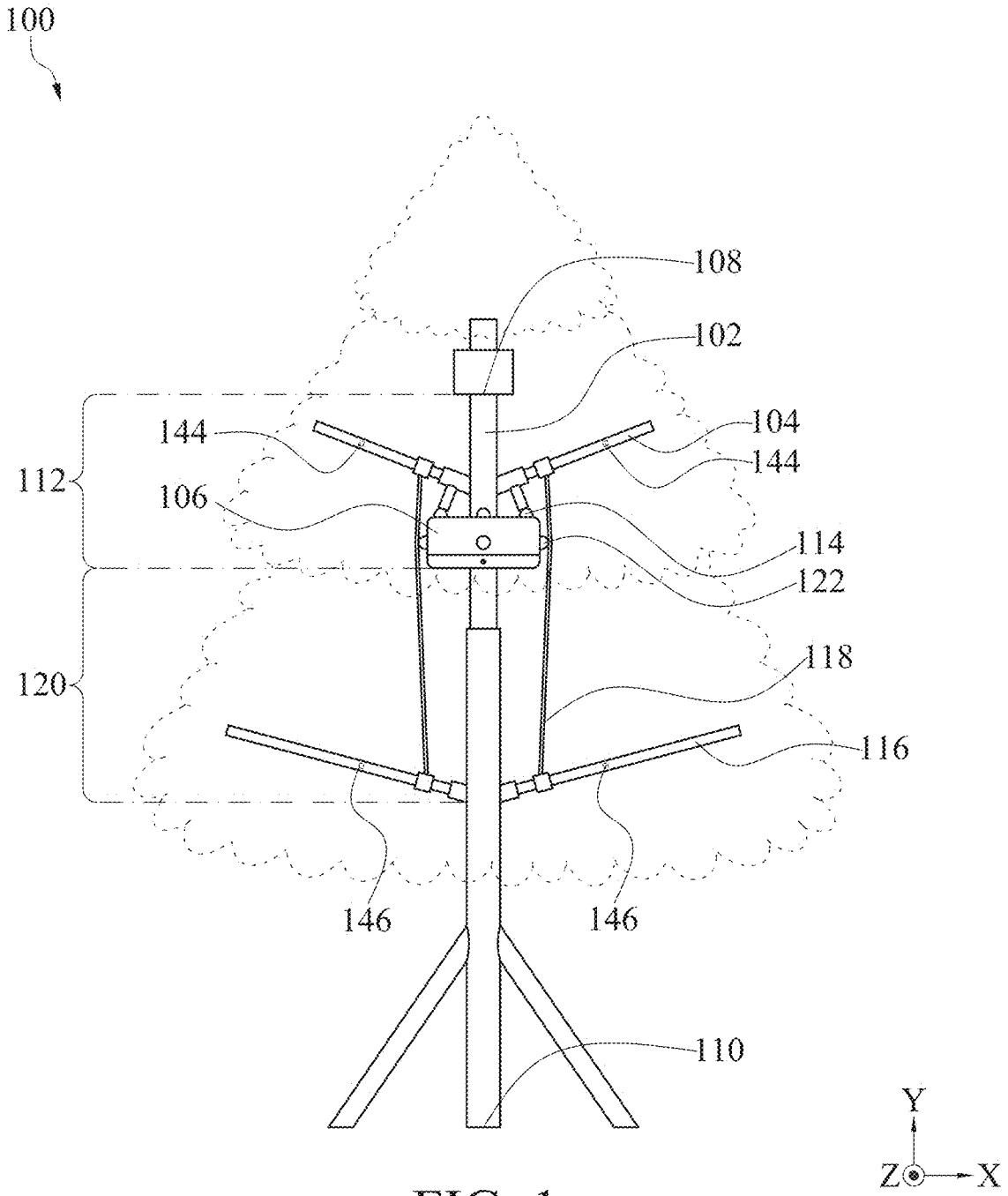
FIG. 1 is a schematic diagram of a dynamic Christmas tree according to some embodiments of the present disclosure.

The following describes the technical solutions of the present disclosure in detail with reference to the accompanying drawings and specific embodiments, to further understand objectives, solutions, and effects of the present disclosure, but the technical solutions are not intended to limit the protection scope of the claims of the present disclosure.

As shown in FIG. 1, FIG. 2, FIG. 3, and FIG. 4, a dynamic Christmas tree 100 includes a main rod 102, a first branch rod 104, and a turntable assembly 106. The main rod 102 includes a top 108 and a bottom 110. An active layer 112 exists between the top 108 and the bottom 110. The first branch rod 104 is connected to the main rod 102 and is located at the active layer 112. The turntable assembly 106 has a first actuating portion 114. The turntable assembly 106 is annularly fixed to the main rod 102, and the first actuating portion 114 extends toward the first branch rod 104. The turntable assembly 106 is configured to: when being actuated, drive the first actuating portion 114 to move around the main rod 102, to intermittently push the first branch rod 104 to swing relative to the main rod 102.

The main rod 102 may be a trunk of the dynamic Christmas tree 100. The main rod 102 may be a hollow rod body. The dynamic Christmas tree 100 may be connected to the turntable assembly 106 by using two wires through the interior of the main rod 102, to provide power or send a signal to the turntable assembly 106.

The first branch rod 104 may be a branch of the dynamic Christmas tree 100. The active layer 112 may be determined by a position at which the first branch rod 104 is disposed on the main rod 102. For example, at least one first branch rod 104 may be disposed at the active layer 112. The at least one first branch rod 104 may be annularly disposed on a surface of the main rod 102. For example, a plurality of first branch rods 104 may be respectively disposed around the main rod 102 at a same height, so that the turntable assembly 106 can actuate one or more first branch rods 104 at a same height position.

Figure 4:
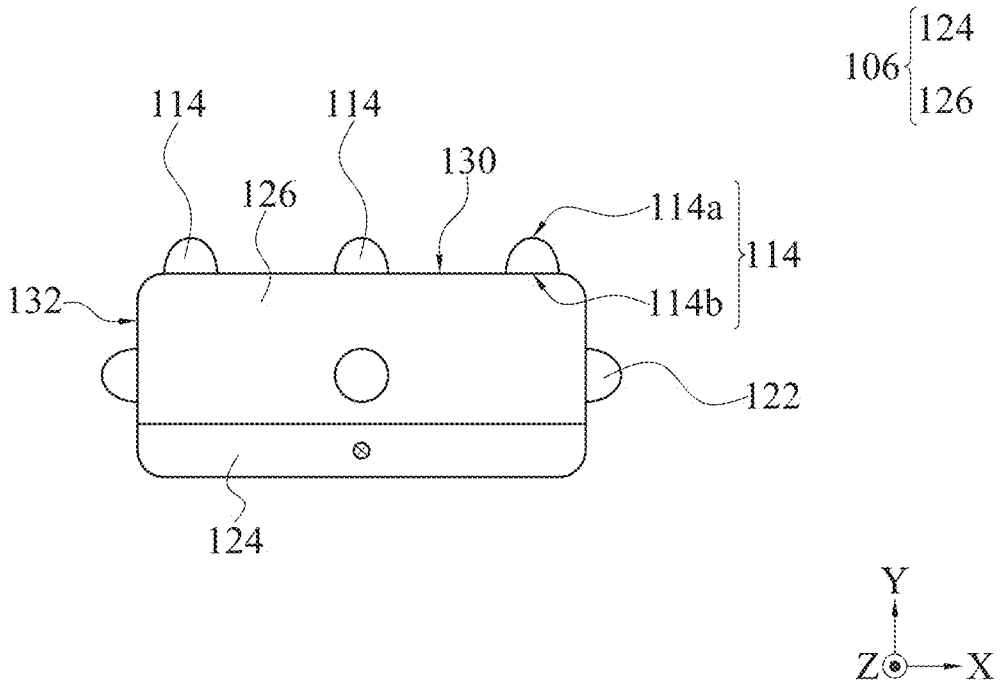
FIG. 4 is a side view of a dynamic Christmas tree according to some embodiments of the present disclosure, with only a turntable assembly being displayed.
Figure 5:
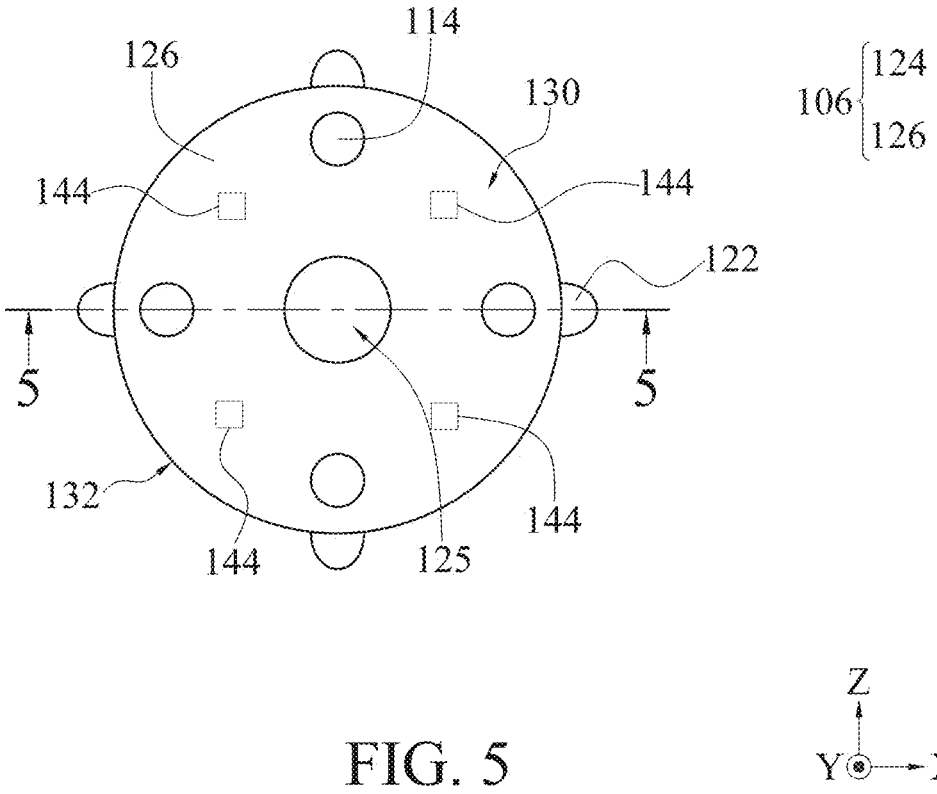
FIG. 5 is a top view of a dynamic Christmas tree according to some embodiments of the present disclosure, with only a turntable assembly being displayed.

The turntable assembly 106 may be fixed to the main rod 102 by using the main rod 102 as a center, so that the turntable assembly 106 can perform rotational movement by using the main rod 102 as an axis. Further, as shown in FIG. 4 and FIG. 5, the first actuating portion 114 may be a protrusion structure extending from the turntable assembly 106 toward the first branch rod 104. That is, the turntable assembly 106 is disposed between the first branch rod 104 and the bottom 110 (that is, the turntable assembly 106 is located below the first branch rod 104), and the first actuating portion 114 may extend to the first branch rod 104 in a direction of a positive Y axis in FIG. 2. Alternatively, the turntable assembly 106 is disposed between the first branch rod 104 and the top 108 (that is, the turntable assembly 106 is located above the first branch rod 104), and the first actuating portion 114 may extend to the first branch rod 104 in a direction of a negative Y axis in FIG. 2. In some embodiments, the turntable assembly 106 may be sectioned from the center (which may be the central shaft hole 125 described later) to form symmetrical and separably assemblable kits (as shown in the turntable assembly 106 sectioned from a direction 5-5 in FIG. 5). The turntable assembly 106 may be dismantled and aligned with the main rod 102, and subsequently assembled and joined together to be fixed onto the main rod 102 (may be joined and fixed by screws or snap-fit structures; for example, as shown in FIG. 5, the turntable assembly 106 on both sides of a section line is fixed by screws passing through in a Z-axis direction, or snap-fit structures are respectively provided on both sides of the section line). Herein, the turntable assembly 106 may be applied to Christmas trees of different specifications, and a user may manually install the turntable assembly 106 to the Christmas tree, to actuate the Christmas tree.

Further, as shown in FIG. 4, the first actuating portion 114 includes a top end 114*a* and a bottom end 114*b*. The top end 114*a* may push against the first branch rod 104. The first branch rod 104 may be located between the top end 114*a* and the bottom end 114*b*. Alternatively, the top end 114*a* may be at the same height as the first branch rod 104 (the top end 114*a* does not extend beyond the first branch rod 104). Accordingly, when the turntable assembly 106 performs rotational motion and the first actuating portion 114 moves around the main rod 102, the first actuating portion 114 may intermittently push against the first branch rod 104 to cause it to vertically swing relative to the main rod 102 (which may refer to the first branch rod 104 swinging toward the top 108 or the bottom 110, that is, swinging in the Y-axis direction). It should be noted that the first actuating portion 114 intermittently pushing against the first branch rod 104 may refer to the position and timing at which the first actuating portion 114 pushes against the first branch rod 104 when the first actuating portion 114 moves circumferentially around the main rod 102. In other words, adjusting a rotational speed of the turntable assembly 106 may change a swing frequency of the first branch rod 104. Accordingly, when the active layer 112 is provided with a plurality of first branch rods 104, the turntable assembly 106 may sequentially push the plurality of first branch rods 104 at the active layer 112 according to the rotational direction (for example, clockwise rotation or counterclockwise rotation), causing the dynamic Christmas tree 100 to present a dynamic visual effect of intermittent swinging of the branch rods (one or more first branch rods 104).

Figure 6:
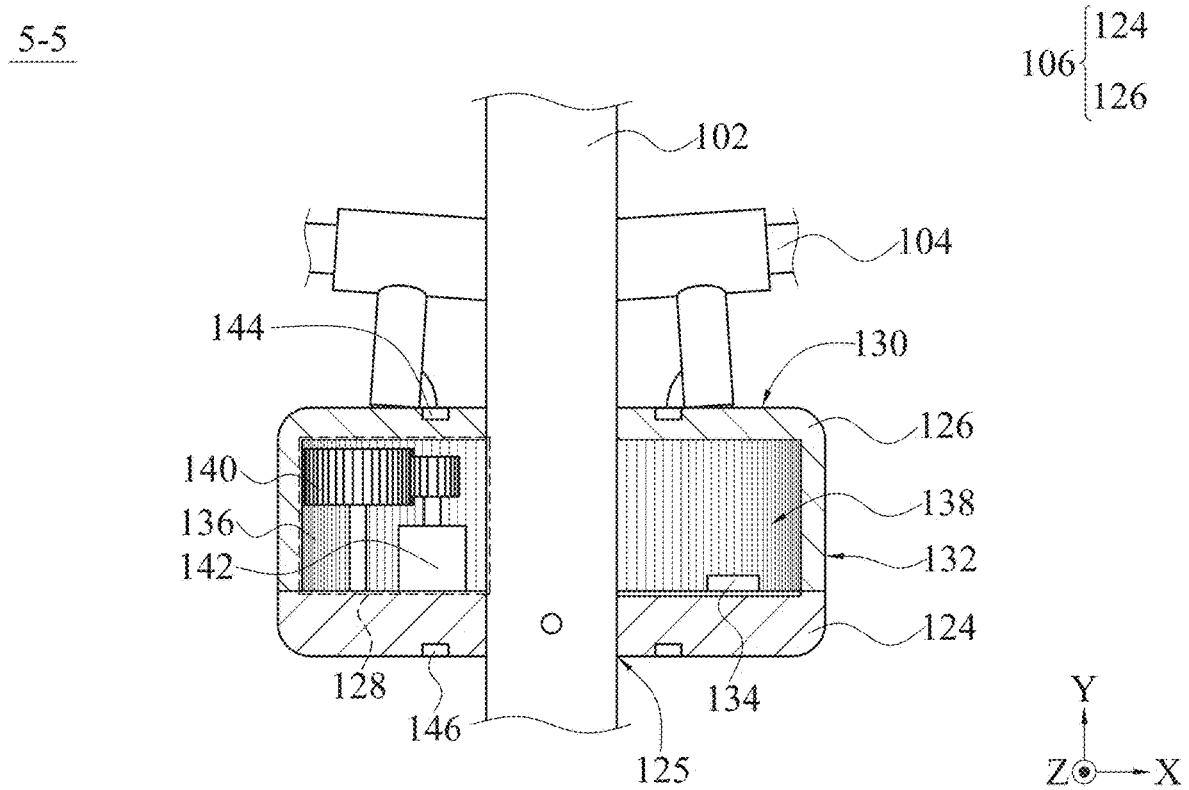
FIG. 6 is a sectional view in a direction 5-5 of FIG. 5, and shows that a first branch rod is not pushed yet.
Figure 7:
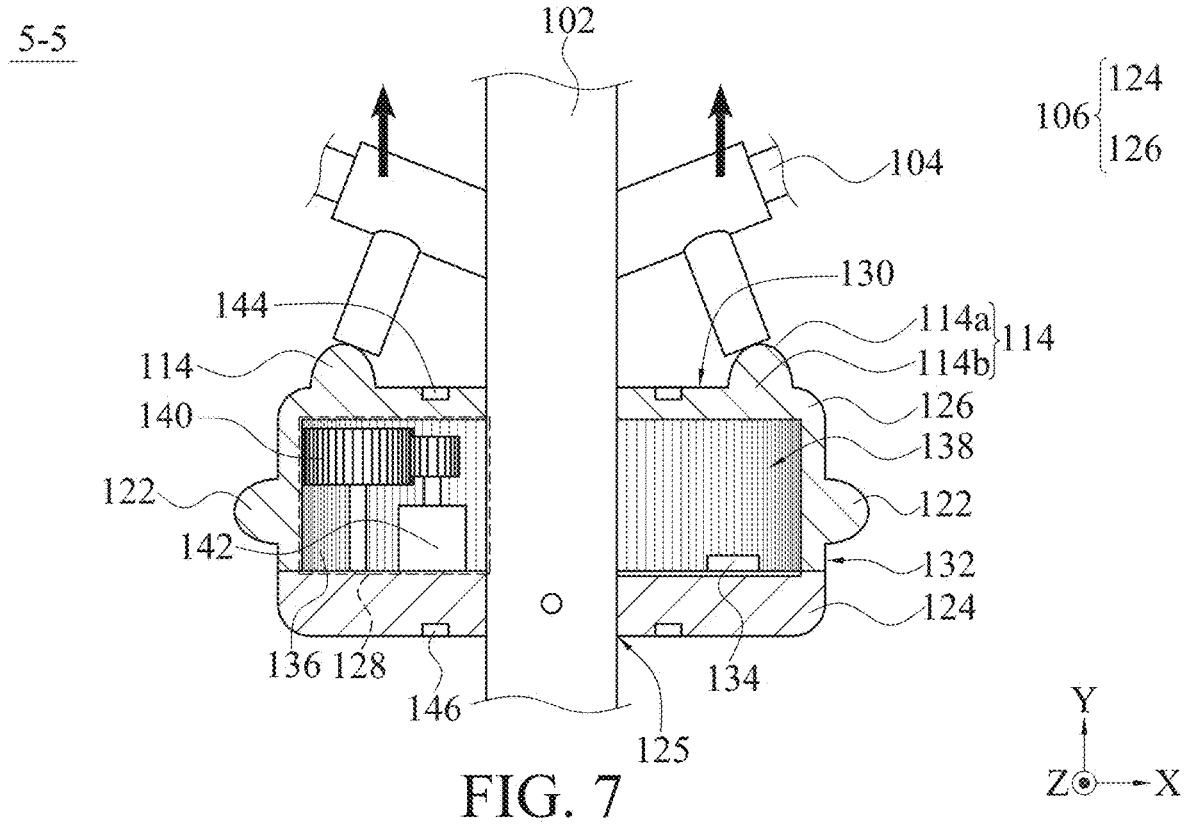
FIG. 7 is a sectional view in a direction 5-5 of FIG. 5, and shows that the first branch rod is pushed.

In some embodiments, as shown in FIG. 6 and FIG. 7, the more the top end 114*a* of the first actuating portion 114 extends beyond the first branch rod 104, the greater the swing amplitude of the first branch rod 104, and the less the top end 114*a* of the first actuating portion 114 extends beyond the first branch rod 104, the smaller the swing amplitude of the first branch rod 104. Accordingly, the dynamic Christmas tree 100 may determine the height of the first actuating portion 114 (that is, the distance between the top end 114*a* and the bottom end 114*b*) according to the swing amplitude of the first branch rod 104.

Figure 2:
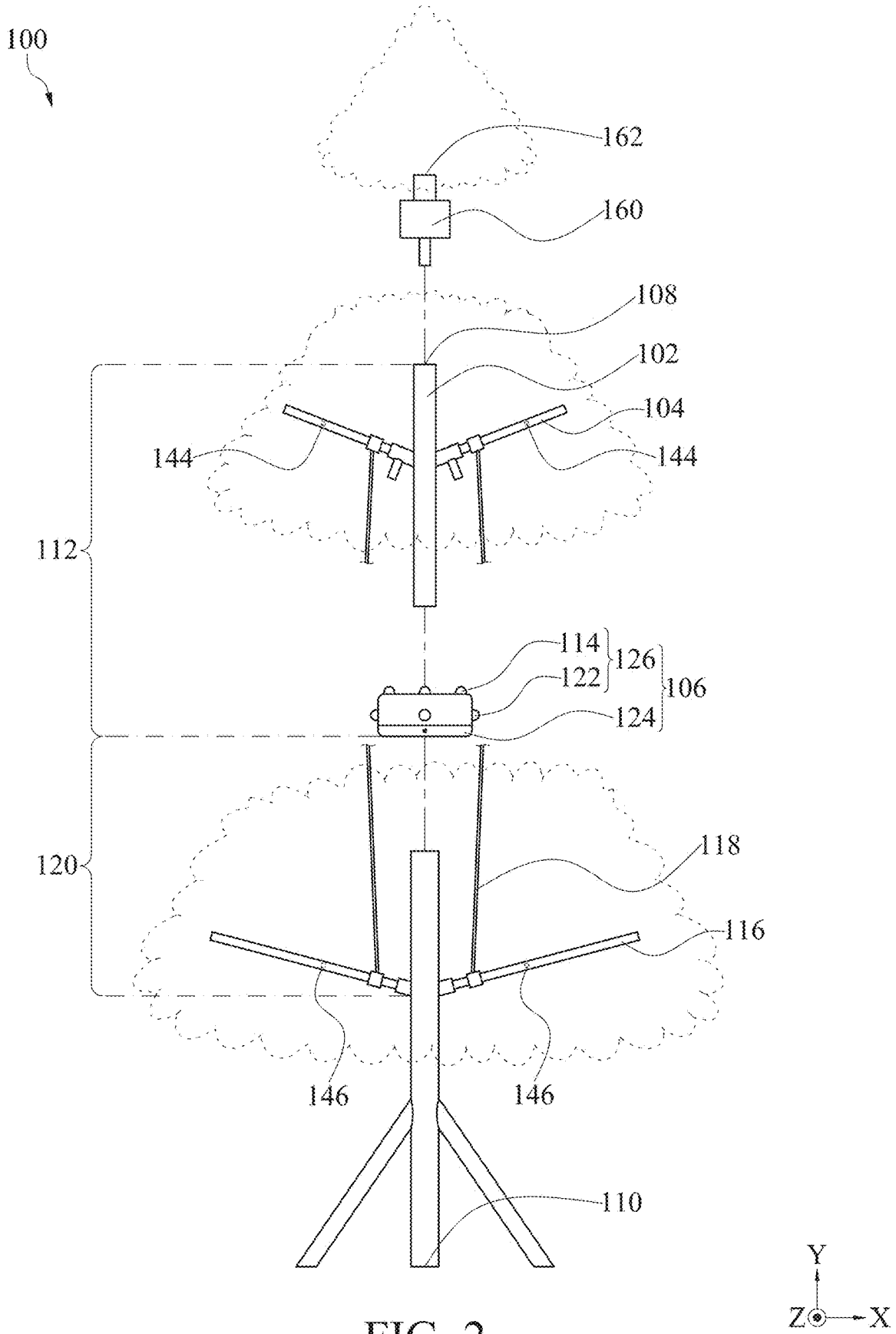
FIG. 2 is an exploded view of a dynamic Christmas tree according to some embodiments of the present disclosure.
Figure 8:
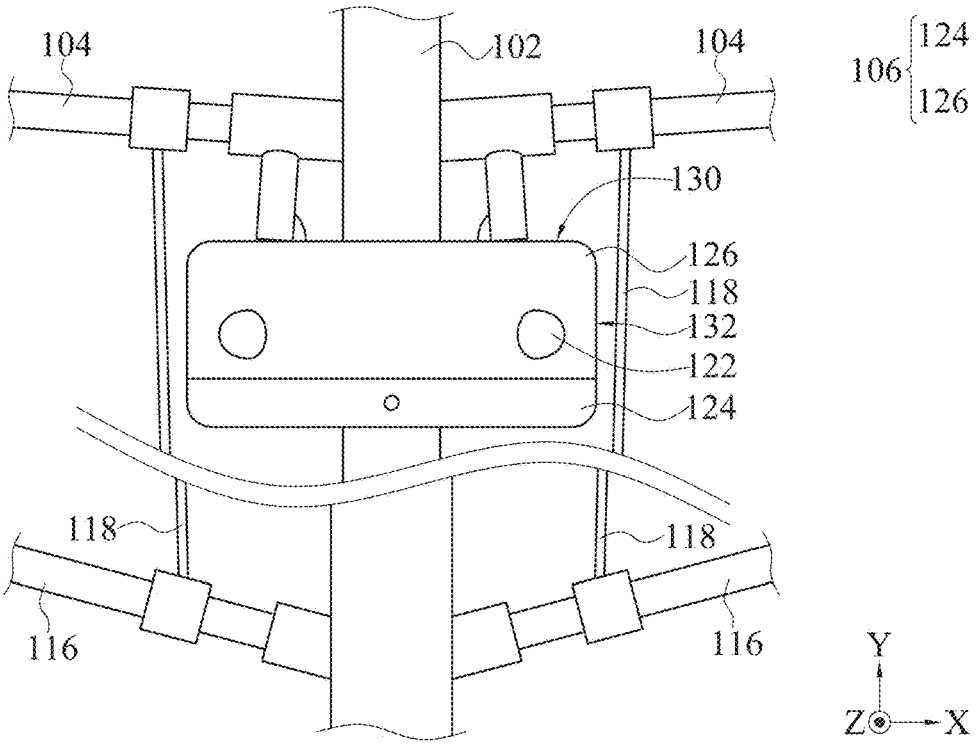
FIG. 8 is a partial schematic diagram of a dynamic Christmas tree according to some embodiments of the present disclosure, and shows that a second branch rod is not pulled yet.
Figure 9:
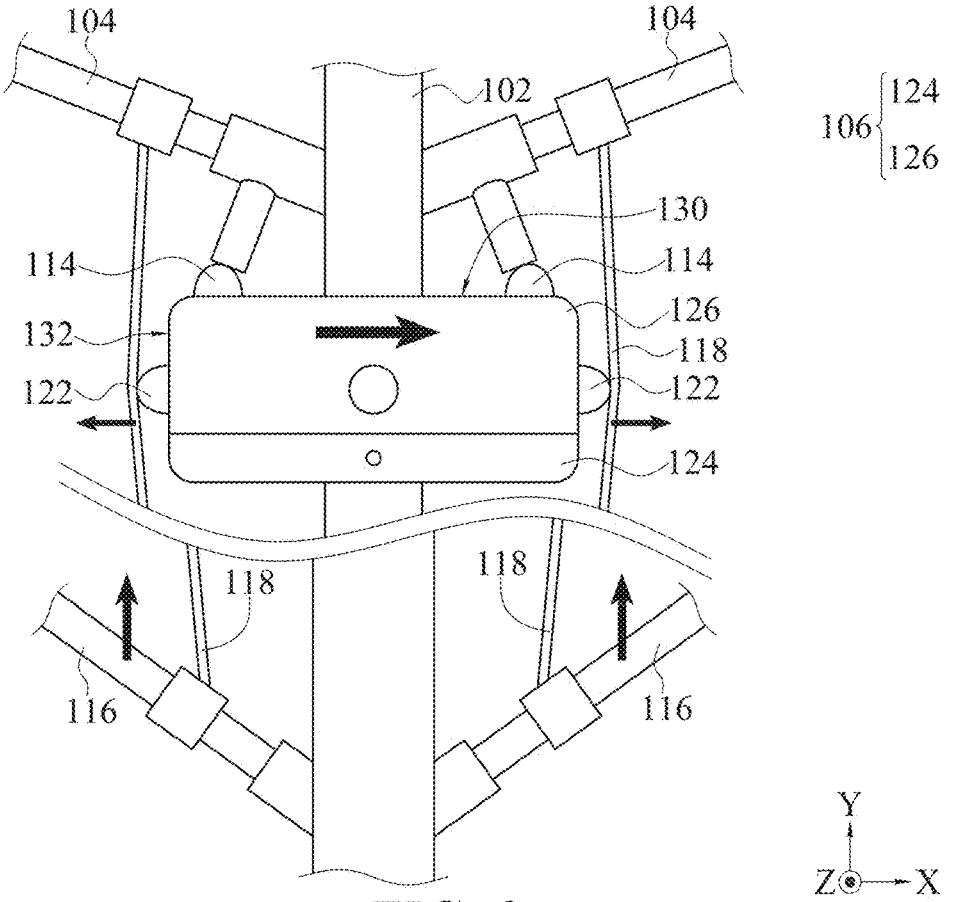
FIG. 9 is a partial schematic diagram of a dynamic Christmas tree according to some embodiments of the present disclosure, and shows that the second branch rod is pulled.

In some embodiments, as shown in FIG. 1, FIG. 2, FIG. 8, and FIG. 9, the dynamic Christmas tree 100 further includes a second branch rod 116 and a connection line 118. The second branch rod 116 is connected to the main rod 102 and is located on a driven layer 120 between the active layer 112 and the bottom 110. One end of the connection line 118 is connected to the second branch rod 116, the other end of the connection line 118 is connected to one of the first branch rod 104 and the turntable assembly 106, and the connection line 118 is located outside the turntable assembly 106. The turntable assembly 106 drives the second branch rod 116 via the connection line 118. For example, the second branch rod 116 may be a branch of the dynamic Christmas tree 100. The driven layer 120 is located between the active layer 112 and the bottom 110, and is determined by a position at which the second branch rod 116 is disposed on the main rod 102. At least one second branch rod 116 may be disposed on the driven layer 120. The at least one second branch rod 116 may be annularly disposed on the surface of the main rod 102. A plurality of second branch rods 116 may be respectively disposed around the main rod 102 at a same height or at different heights. The first branch rod 104 and the second branch rod 116 at a same circumferential position of the main rod 102 are connected to each other by using the connection line 118 (as shown in FIG. 8 and FIG. 9). Accordingly, when the first branch rod 104 is pushed by the first actuating portion 114, the connected second branch rod 116 is driven via the connection line 118, causing the second branch rod 116 to simultaneously swing relative to the main rod 102 (which may refer to the second branch rod 116 swinging toward the top 108 or the bottom 110, that is, swinging in the Y-axis direction). In some embodiments, the first branch rod 104 and the main rod 102 have a first swing angle, the second branch rod 116 and the main rod 102 have a second swing angle, and the first swing angle is greater than or equal to the second swing angle. The first swing angle and/or the second swing angle is less than or equal to 60 degrees. In some embodiments, as shown in FIG. 2, the active layer 112 and the driven layer 120 may be separated from each other. That is, the main rod 102 of the active layer 112 is detachably connected to the main rod 102 of the driven layer 120. Accordingly, when it is desired to assemble or disassemble the turntable assembly 106 onto or from the main rod 102, the main rod 102 of the active layer 112 and the main rod 102 of the driven layer 120 may be separated, allowing the turntable assembly 106 to be assembled onto the main rod 102 of the driven layer 120. In some embodiments, the turntable assembly 106 may be screwed to the main rod 102.

Figure 13:
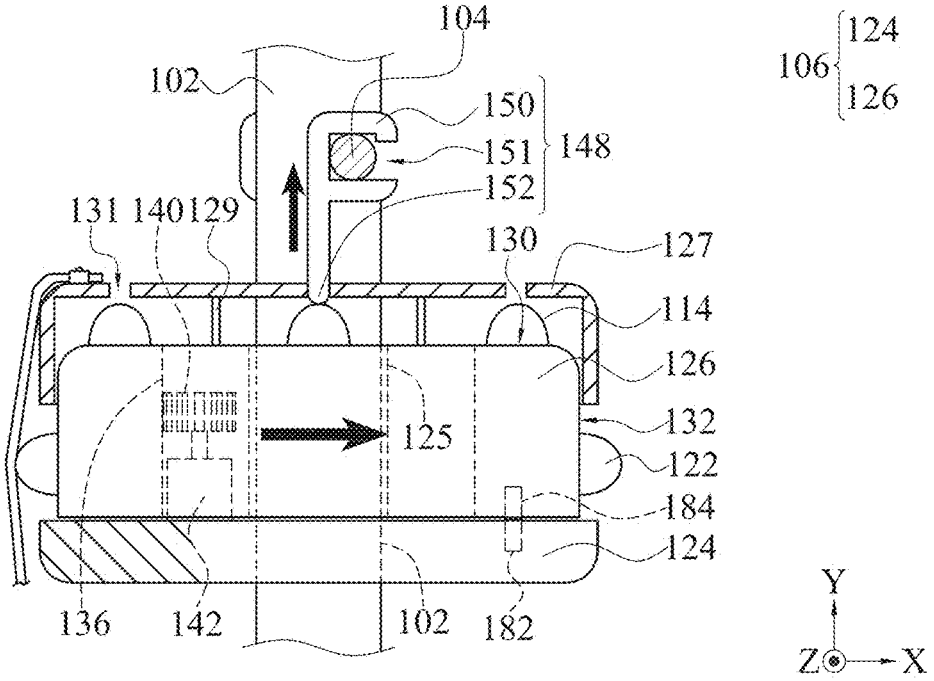
FIG. 13 is a partial schematic diagram of a dynamic Christmas tree according to some embodiments of the present disclosure, and shows that the first actuating portion pushes the clasp member after a top cover is sectioned.

In some embodiments, as shown in FIG. 8, FIG. 9, and FIG. 13, one end of the connection line 118 is connected to the second branch rod 116, and the other end of the connection line 118 is connected to the turntable assembly 106 (which may be connected to a top cover 127 described later). The turntable assembly 106 further has a second actuating portion 122. The second actuating portion 122 extends toward the connection line 118. The first actuating portion 114 and the second actuating portion 122 are staggered at a peripheral position of the turntable assembly 106. The turntable assembly 106 is configured to: when being actuated, drive the first actuating portion 114 and the second actuating portion 122 to move around the main rod 102, so as to intermittently push (flick) the connection line 118. Specifically, the second actuating portion 122 may push the connection line 118 away from the main rod 102, so that the connection line 118 can pull the second branch rod 116 by using the top cover 127 as a fulcrum. As shown in FIG. 13, the connection line 118 is connected to the top cover 127 by using an adjustment clasp, so as to adjust tightness of the connection line 118.

In some embodiments, the second actuating portion 122 and the first actuating portion 114 may be disposed on different planes. Using FIG. 6 and FIG. 8 as an example, the turntable assembly 106 includes a fixed disk 124, a turntable 126, and a drive assembly 128. The fixed disk 124 has a central axis hole 125, and the central axis hole 125 is annularly fixed to the main rod 102. The turntable 126 is movably connected to the fixed disk 124. The turntable 126 has an upper surface 130 and a side surface 132. The first actuating portion 114 is located on the upper surface 130, and the second actuating portion 122 is located on the side surface 132. In some embodiments, the second actuating portion 122 and the first actuating portion 114 may be disposed on a same plane. For example, the first actuating portion 114 and the second actuating portion 122 are both disposed on the upper surface 130 (not shown in the figure), and are respectively disposed at different peripheral positions of the upper surface 130.

In some embodiments, as shown in FIG. 9, the first actuating portion 114 and the second actuating portion 122 may have spherical or arc structures. When the first actuating portion 114 contacts the first branch rod 104, the first branch rod 104 may be guided by a spherical, conical, or arc structure of the first actuating portion 114, to move along a surface of the first actuating portion 114. Similarly, when the second actuating portion 122 contacts the connection line 118, the connection line 118 may be guided by a spherical, conical, or arc structure of the second actuating portion 122, to move along a surface of the second actuating portion 122.

Figure 3:
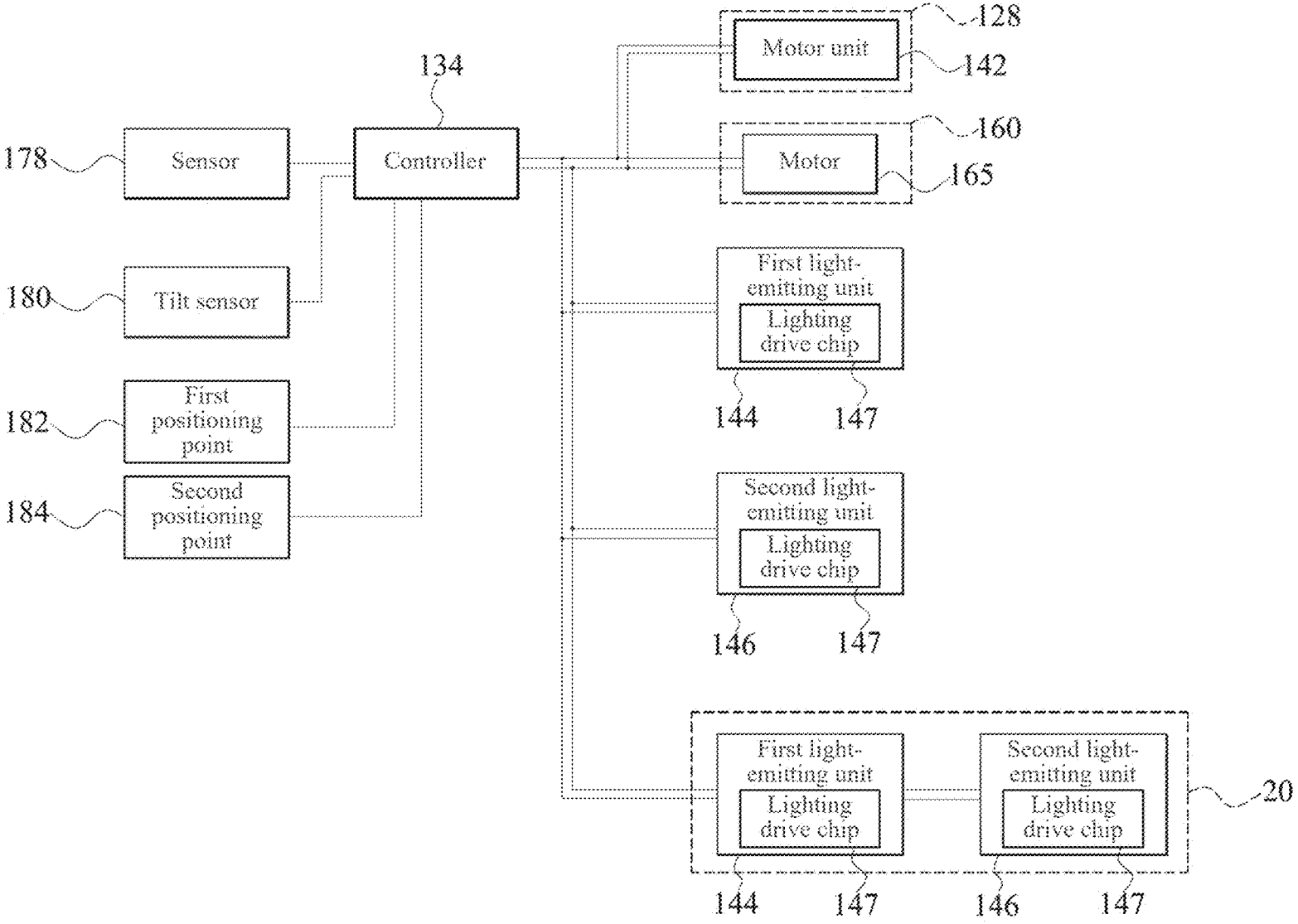
FIG. 3 is a block diagram of a dynamic Christmas tree according to some embodiments of the present disclosure.

In some embodiments, as shown in FIG. 3 and FIG. 6, the dynamic Christmas tree 100 further includes a controller 134. The controller 134 is configured to generate a drive signal, and the turntable assembly 106 is actuated according to the drive signal. Specifically, the drive assembly 128 is configured to drive, according to the drive signal, the turntable 126 to rotate relative to the main rod 102. The controller 134 may be, for example, an integrated circuit that can drive and control a motor. The controller 134 may be disposed inside the turntable assembly 106 (a space between the fixed disk 124 and the turntable 126), and is electrically connected to the drive assembly 128 for control. Alternatively, the drive assembly 128 may be disposed outside the turntable assembly 106, and the drive assembly 128 is controlled in a wired or wireless manner. The drive signal may control a rotational speed or a swing frequency of the drive assembly 128. For example, the drive assembly 128 may have a control program pre-written therein, and the drive assembly 128 may execute a preset control program according to the drive signal to perform a corresponding action. For another example, the drive signal may be a pulse-width modulation (Pulse-Width Modulation, PWM) signal. The drive assembly 128 may adjust a current input to the drive assembly 128 according to a duty ratio of the pulse-width modulation signal, so as to change the rotational speed or the swing frequency. It should be noted that the turntable assembly 106 may have a range of swing angle (that is, a travel of swing) predetermined, such that the turntable assembly 106 can repeatedly oscillate back and forth within the predetermined angle.

In some embodiments, as shown in FIG. 6, an inner edge of the side surface 132 of the turntable 126 has an annular tooth portion 136. An accommodating portion 138 is provided between the turntable 126 and the fixed disk 124, and the drive assembly 128 is disposed in the accommodating portion 138. The drive assembly 128 includes a driven gear 140 and a motor unit 142. The motor unit 142 may be a synchronous motor or a stepping motor. The driven gear 140 meshes with the annular tooth portion 136, and the motor unit 142 is configured to drive the driven gear 140 according to the drive signal. The driven gear 140 may be directly or indirectly driven by the motor unit 142. As shown in FIG. 6, one end of the motor unit 142 is provided with a gear that drives the driven gear 140, thereby causing the driven gear 140 to drive the turntable 126. In some embodiments, the driven gear 140 may alternatively be directly connected to one end of the motor unit 142 (shown in FIG. 10).

Figure 10:
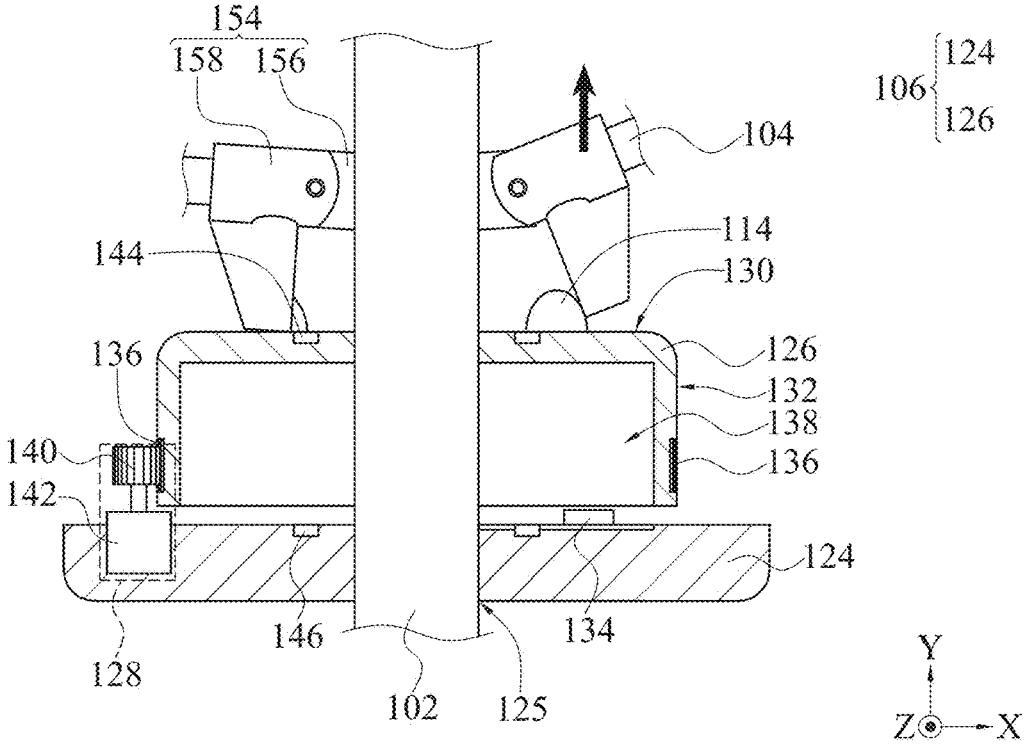
FIG. 10 is a sectional view of a dynamic Christmas tree according to some embodiments of the present disclosure, and shows that an annular tooth portion is disposed on a side surface.

In some embodiments, as shown in FIG. 10, the annular tooth portion 136 may alternatively be disposed on the side surface 132. The drive assembly 128 is disposed on the fixed disk 124. The drive assembly 128 includes a driven gear 140 and a motor unit 142, the driven gear 140 meshes with the annular tooth portion 136, and the motor unit 142 is configured to drive the driven gear 140 according to the drive signal.

In some embodiments, as shown in FIG. 1, FIG. 2, FIG. 3, and FIG. 6, the upper surface 130 has a first light-emitting unit 144, and the first light-emitting unit 144 is configured to generate first light oriented to the top 108 according to the drive signal. The fixed disk 124 has a second light-emitting unit 146, and the second light-emitting unit 146 is configured to generate second light oriented to the bottom 110 according to the drive signal. Specifically, the first light-emitting unit 144 and the second light-emitting unit 146 may be light-emitting diodes. The first light-emitting unit 144 and the second light-emitting unit 146 are respectively exposed on the fixed disk 124 and the turntable 126, so that the first light and the second light can be respectively irradiated to the top 108 or the bottom 110. It should be noted that the first light-emitting unit 144 and the second light-emitting unit 146 may each have a lighting drive chip 147. The lighting drive chip 147 may control brightness or flicker frequency of the first light-emitting unit 144 or the second light-emitting unit 146 according to a duty cycle of the drive signal. Accordingly, the first light-emitting unit 144 and the second light-emitting unit 146 may generate a light-emitting effect such as gradient luminance or flickering. In some embodiments, the first light-emitting unit 144 and the second light-emitting unit 146 may alternatively be disposed on the first branch rod 104 or the second branch rod 116 (as shown in FIG. 1). For example, the first light-emitting unit 144 is disposed on the first branch rod 104, so that the first light can be irradiated to the top 108, and the second light-emitting unit 146 is disposed on the second branch rod 116, so that the second light can be irradiated to the bottom 110, to form a projection lamp corresponding to a tree top and a tree bottom.

In some embodiments, as shown in FIG. 3, the first light-emitting unit 144 and the second light-emitting unit 146 may be separately packaged with the lighting drive chip 147 as a single integrated circuit, and disposed on at least one of the top 108, the active layer 112, the driven layer 120, and the bottom 110. The first light-emitting unit 144 and the second light-emitting unit 146 are respectively connected to the controller 134 by using two wires. The first light-emitting unit 144 and the second light-emitting unit 146 each have a lighting drive chip 147, and the lighting drive chip 147 is configured to selectively drive the first light-emitting unit 144 and the second light-emitting unit 146 according to the drive signal (to be described in detail later). In some embodiments, as shown in FIG. 3, the first light-emitting unit 144 and the second light-emitting unit 146 may alternatively be connected in series via two power wires to form a controllable light-emitting diode light string 20. The light-emitting diode light string 20 may be arranged by a user on the dynamic Christmas tree 100, for example, by hanging it on the first branch rod 104 and/or the second branch rod 116. It should be noted that the light-emitting diode light string 20 includes the first light-emitting unit 144 and the second light-emitting unit 146 that are connected in series by using two wires. The lighting drive chip 147 of the first light-emitting unit 144 and the lighting drive chip 147 of the second light-emitting unit 146 may have address code sequentially set, and the controller 134 may control the first light-emitting unit 144 or the second light-emitting unit 146 at a specified address according to the address code (to be described in detail later).

In some embodiments, as shown in FIG. 1, FIG. 2, and FIG. 6, The drive signal may be transmitted via power wires (which may be a positive wire and a negative wire), and the drive signal may refer to a combination of signals generating a high level or a low level on the power wires. For example, when the drive signal is at a high level (positive voltage), the first light-emitting unit 144 and the second light-emitting unit 146 may respectively generate first light and second light. When the drive signal is at a low level (negative voltage, which may be 0 V), the first light-emitting unit 144 and the second light-emitting unit 146 will not generate the first light and the second light (respectively presenting an extinguished state). In some embodiments, a control command may be carried in the drive signal. When receiving the drive signal, the controller 134 may ignore the control command and only control the turntable assembly 106 by using the drive signal. When receiving the drive signal, the lighting drive chip 147 may control the first light-emitting unit 144 and the second light-emitting unit 146 according to the control command. In some embodiments, the controller 134 may superimpose a control command and a communication command signal onto the drive signal. The communication command signal carries address code of the first light-emitting unit 144 and the second light-emitting unit 146. The lighting drive chip 147 of the first light-emitting unit 144 or the second light-emitting unit 146 can selectively drive the first light-emitting unit 144 or the second light-emitting unit 146 according to the address code of the communication command signal. For example, when the address code superimposed on the drive signal corresponds to the first light-emitting unit 144, only the lighting drive chip 147 of the first light-emitting unit 144 will execute the control command, while the second light-emitting unit 146 will not execute the control command. Conversely, when the address code superimposed on the drive signal corresponds to the second light-emitting unit 146, only the lighting drive chip 147 of the second light-emitting unit 146 will execute the control command, while the first light-emitting unit 144 will not execute the control command.

In some embodiments, the control command includes a reset command. The lighting drive chip 147 resets a preset control time sequence according to the reset command. For example, when the lighting drive chip 147 receives the drive signal (that is, obtains power through a power wire), the lighting drive chip 147 may execute a corresponding lighting mode (for example, functions such as flashing, breathing, candle flickering, or star twinkling) according to a preset control time sequence. When the lighting drive chip 147 receives a reset command, the preset control time sequence of the lighting drive chip 147 is reset. By setting a sending interval of the reset command, the lighting drive chip 147 can maintain a constant bright or constant dark lighting effect. It should be noted that, as the communication command signal and the reset command are superimposed on the drive signal and transmitted to two power wires at a frequency higher than once every 10 ms (milliseconds). A pulse width of the reset command is set to be greater than 1 microsecond to several milliseconds. Therefore, impact of the communication command signal and the reset command on the lighting units (144, 146) is less than time required for a human eye to perceive a change in illumination, and does not affect the visual lighting effect. In addition, the drive assembly 128 may also ignore a signal whose pulse width is greater than 1 microsecond to several milliseconds, so that the motor unit 142 may not be interfered with by the reset command to control the rotational speed of the turntable 126.

Figure 11:
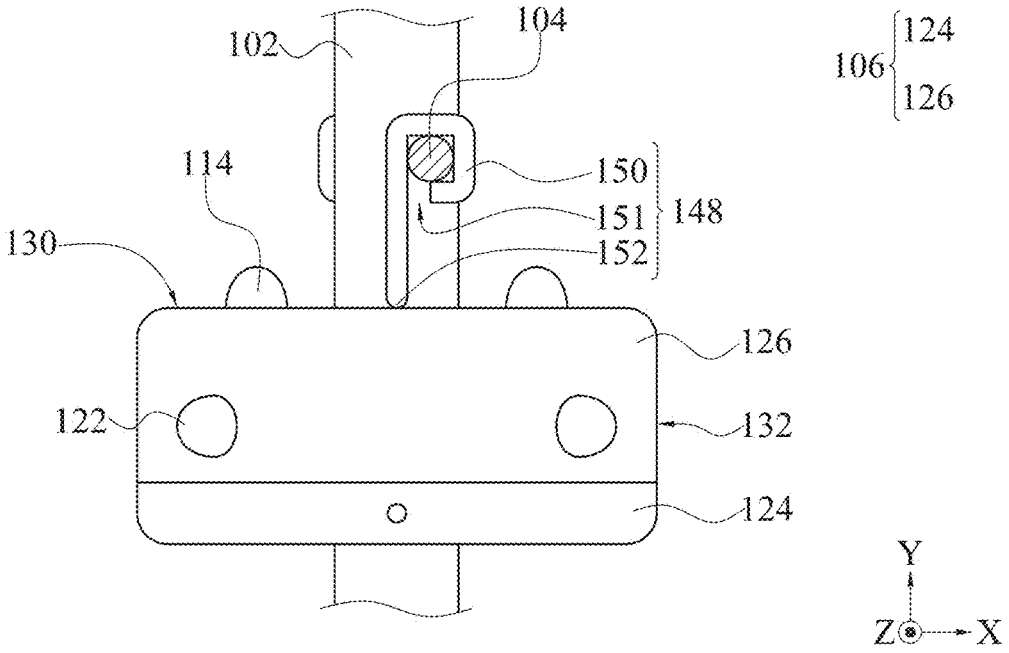
FIG. 11 is a partial schematic diagram of a dynamic Christmas tree according to some embodiments of the present disclosure, and shows that a clasp member clasps a first branch rod, and the first branch rod is not pushed yet.
Figure 12:
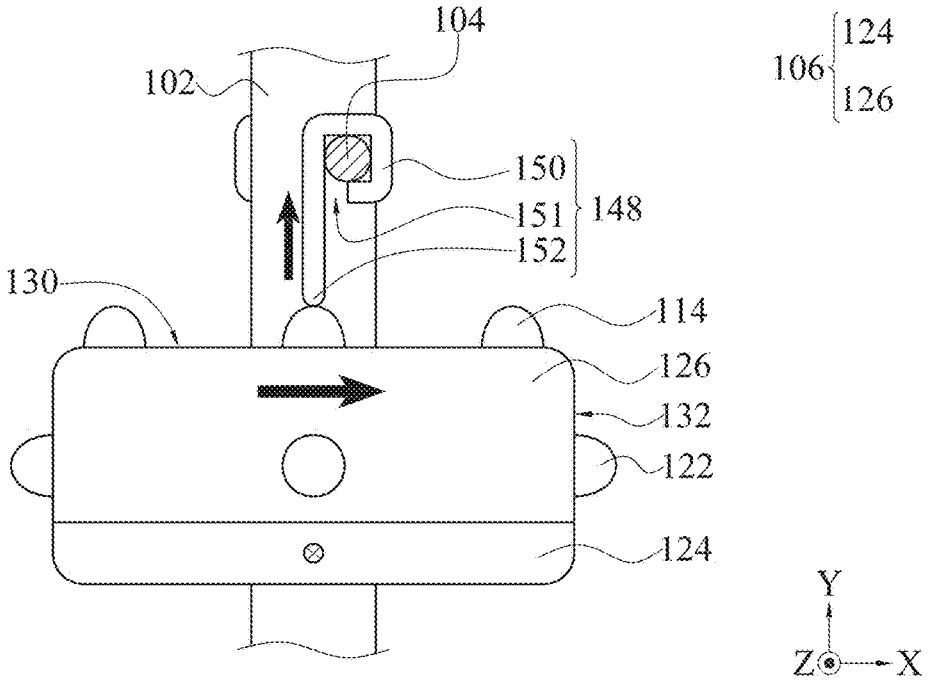
FIG. 12 is a partial schematic diagram of a dynamic Christmas tree according to some embodiments of the present disclosure, and shows that the clasp member clasps the first branch rod, and the first branch rod is pushed by a first actuating portion.

In some embodiments, the dynamic Christmas tree 100 may be designed as the fixed or movable first branch rod 104, so that the turntable assembly 106 can actuate the first branch rod 104. For example, as shown in FIG. 11 and FIG. 12, the dynamic Christmas tree 100 further includes a clasp member 148. Two ends of the clasp member 148 respectively have a clasp portion 150 and an abutment portion 152. The clasp portion 150 clasps the first branch rod 104, the abutment portion 152 normally abuts against the upper surface 130, and the abutment portion 152 is located on a moving track of the first actuating portion 114. Accordingly, a height of the first actuating portion 114 may be lowered or a swing amplitude of the first branch rod 104 may be increased according to an extension length of the abutment portion 152. The abutment portion 152 may alternatively be an arc surface, to reduce a friction force between the abutment portion 152 and the first actuating portion 114. The turntable assembly 106 may also be applied to a common Christmas tree. The user can install the clasp member 148 on the branch, and the turntable assembly 106 can then intermittently actuate the abutment portion 152 of the clasp member 148, thereby simultaneously lifting the clasp member 148 and the first branch rod 104 to create a swinging effect on the branch. In some embodiments, the clasp portion 150 further includes an opening 151, and a width of the opening 151 is less than or equal to a diameter of the first branch rod 104. When the first branch rod 104 passes through the opening 151, the clasp member 148 can, by virtue of elasticity of its own material, slightly expand the width of the opening 151, so that the first branch rod 104 can pass through the opening 151 and be limited within the clasp portion 150.

Figure 14:
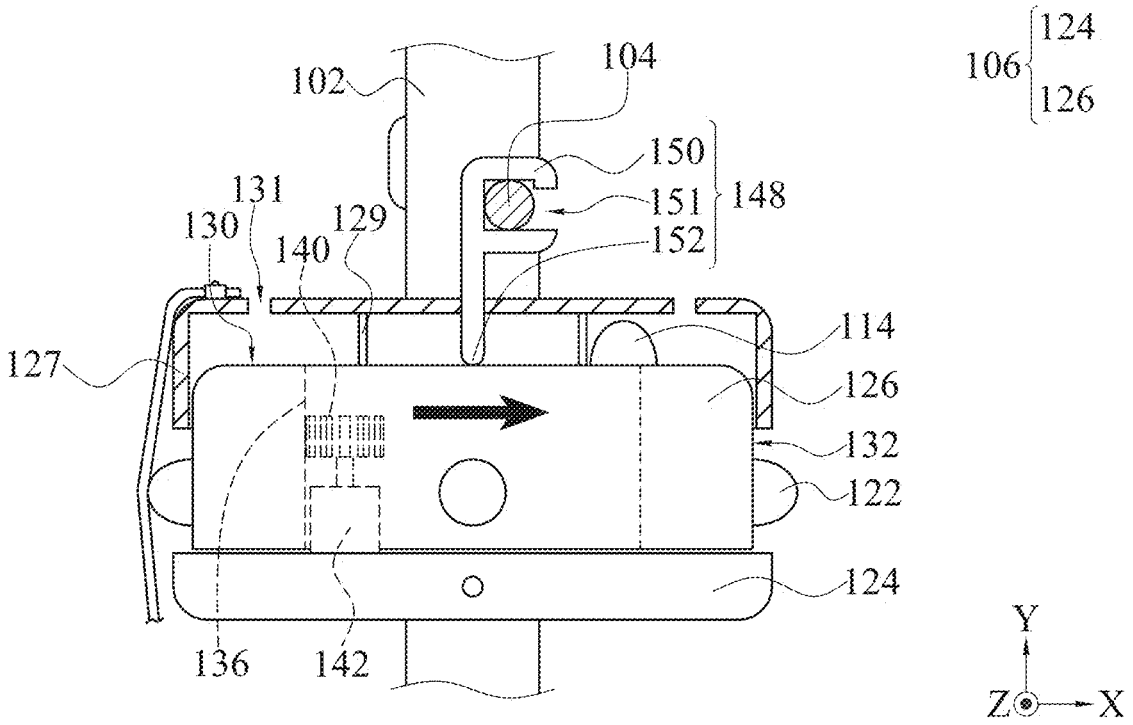
FIG. 14 is a partial schematic diagram of a dynamic Christmas tree according to some embodiments of the present disclosure, and shows that the first actuating portion does not push the clasp member after the top cover is sectioned.

In some embodiments, as shown in FIG. 13 and FIG. 14, the turntable assembly 106 further includes a top cover 127. The top cover 127 covers the turntable 126. A distance between the top cover 127 and the turntable 126 may be maintained by a bracket 129 between the top cover 127 and the fixed disk 124, so that the turntable 126 can rotate smoothly between the top cover 127 and the fixed disk 124. The top cover 127 has at least one through-hole 131. Each through-hole 131 respectively corresponds to the clasp member 148 on a plumb line, and each clasp member 148 extends into a corresponding through-hole 131. When the first actuating portion 114 actuates the clasp member 148, the clasp member 148 lifts or descends within a range of the through-hole 131. Herein, as the first actuating portion 114 actuates the clasp member 148 following its circular moving track, the through-hole 131 serves to provide a lateral limiting function (in the X-axis direction as shown in the figure) for the clasp member 148, so as to prevent the clasp member 148 from deviating from the track of the first actuating portion 114. In some embodiments, the top cover 127, the fixed disk 124, and the turntable 126 are disassembled from or assembled to the main rod 102 according to the central shaft hole 125. As previously described, the turntable assembly 106 can be sectioned from the central shaft hole 125 to form symmetrical and separably assemblable kits. In this embodiment, the top cover 127, the fixed disk 124, and the turntable 126 are split into halved kits according to the central shaft hole 125, so as to be detached from or assembled onto the main rod 102.

In some embodiments, as shown in FIG. 1 and FIG. 10, the dynamic Christmas tree 100 further includes a connecting rod 154. The connecting rod 154 is disposed at the active layer 112. The connecting rod 154 has a fixed segment 156 and a movable segment 158, one end of the fixed segment 156 is connected to the main rod 102, one end of the movable segment 158 is pivotally connected to the other end of the fixed segment 156, and the first branch rod 104 is connected to the other end of the movable segment 158. The first actuating portion 114 may push the movable segment 158, to indirectly drive the first branch rod 104. When the user intends to store the dynamic Christmas tree 100, each first branch rod 104 can also have its movable segment 158 folded up against the main rod 102, so as to reduce an overall volume of the dynamic Christmas tree 100.

Figure 15:
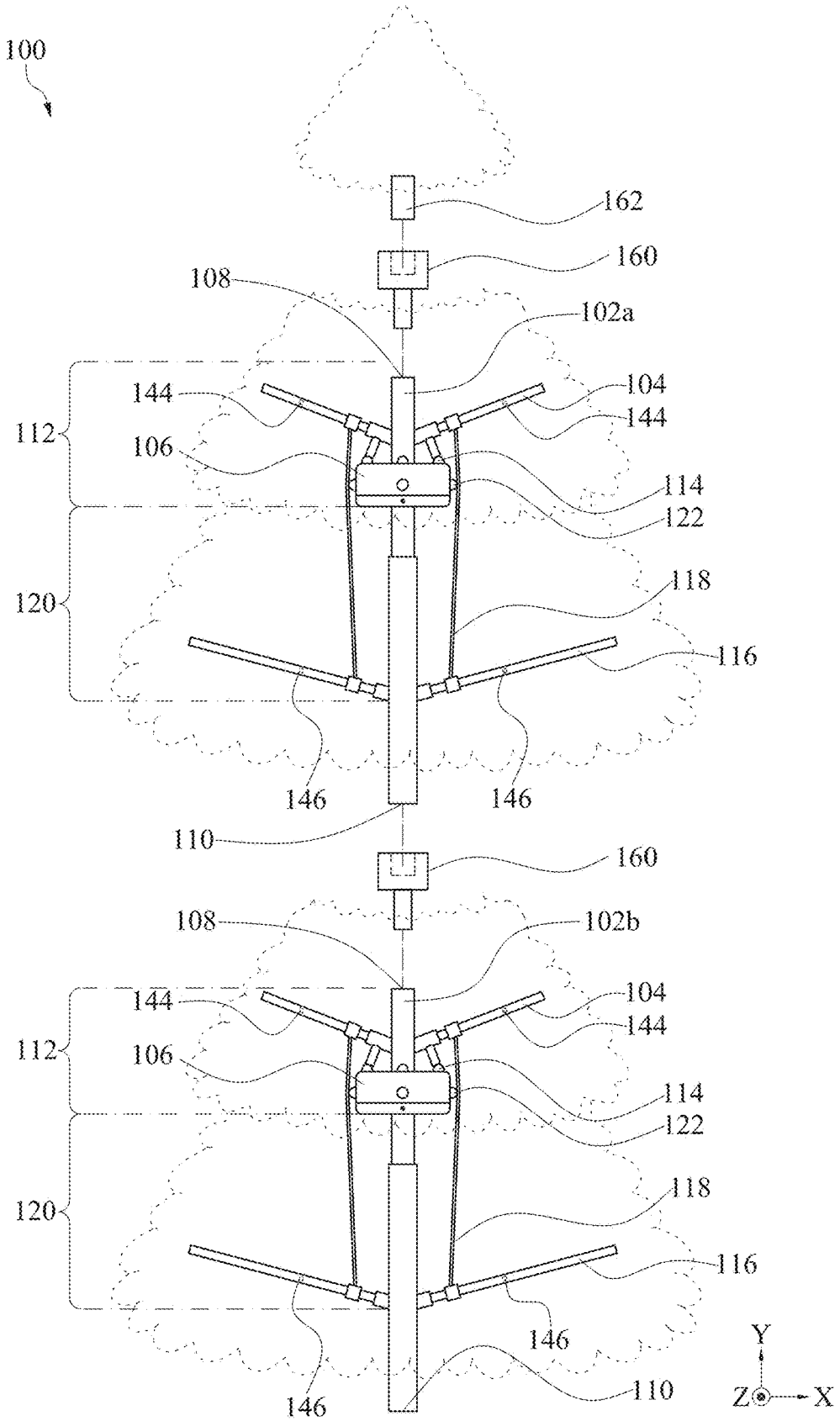
FIG. 15 is a partial exploded view of a dynamic Christmas tree according to some embodiments of the present disclosure, and shows that a main rod has a plurality of active layers and driven layers.

In some embodiments, as shown in FIG. 15, the dynamic Christmas tree 100 further includes a rotational connection assembly 160 and a top rod 162. One end of the rotational connection assembly 160 is connected to the top 108 of the main rod 102. The top rod 162 is connected to the other end of the rotational connection assembly 160. The rotational connection assembly 160 is configured to rotate the top rod 162 according to the drive signal. Accordingly, when the rotational connection assembly 160 rotates the top rod 162, the top rod 162 can perform horizontal rotation relative to the main rod 102 (which refers to rotation in the X-axis direction as shown in the figure, and may be clockwise rotation or counterclockwise rotation). In some embodiments, as shown in FIG. 15, the main rod 102 is formed by assembling a first rod body 102*a* and a second rod body 102*b*. The first rod body 102*a* and the second rod body 102*b* each have an active layer 112 and a driven layer 120. One end of the rotational connection assembly 160 is connected to the bottom 110 of the first rod body 102*a*, and the other end of the rotational connection assembly 160 is connected to the top 108 of the second rod body 102*b*. The rotational connection assembly 160 is configured to rotate the first rod body 102*a* according to the drive signal. Accordingly, if the dynamic Christmas tree 100 has a plurality of active layers 112 and driven layers 120, the rotational connection assembly 160 may be disposed between respective segments of the main rod 102, so as to control actions of the turntable assembly 106 and the first light-emitting unit 144 or the second light-emitting unit 146 in different segments. Control in different segments may be synchronized or unsynchronized control, and the controller 134 may determine the actions (such as rotational speed, swing frequency, swing angle, rotation angle, or the aforementioned lighting effects) in different segments by using the communication command signal. For example, the controller 134 may control a swing angle of the turntable assembly 106 in the first rod body 102*a* to be greater than a swing angle of the turntable assembly 106 in the second rod body 102*b*. A set height of the second rod body 102*b* may be close to a height of a child, therefore reducing the swing angle of the turntable assembly 106 in the second rod body 102*b*. Hereby, it is possible to prevent the first branch rod 104 or the second branch rod 116 of the second rod body 102*b* from pushing over a child and causing an accident.

Figure 16:
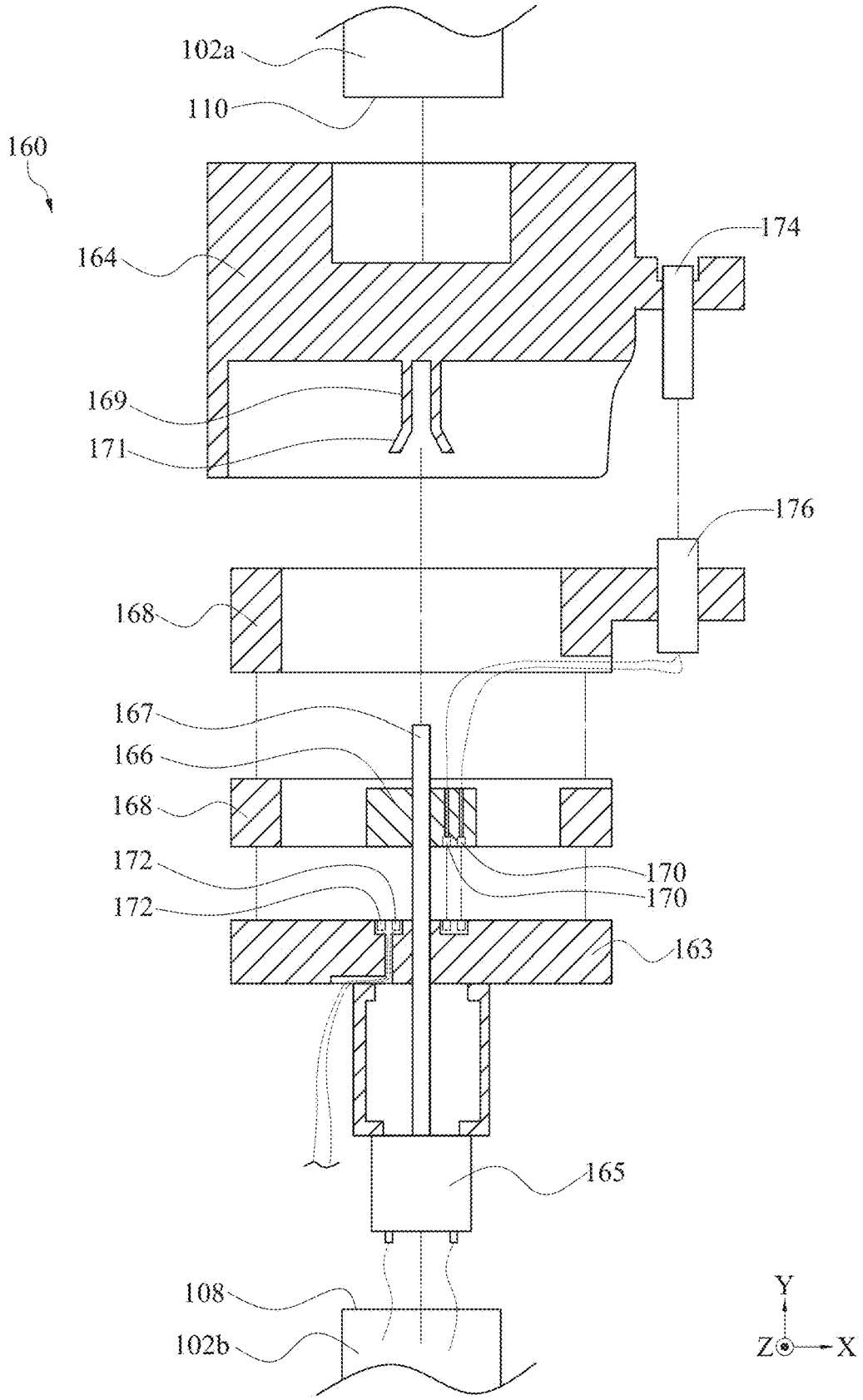
FIG. 16 is a sectional view of a rotational connection assembly according to some embodiments of the present disclosure.

In some embodiments, as shown in FIG. 15 and FIG. 16, The rotational connection assembly 160 includes a base 163, a rotor 164, and a motor 165. The base 163 may be connected to the top 108 of the main rod 102 (which may be the top 108 of the first rod body 102*a* or the second rod body 102*b*). The base 163 may be electrically connected to the controller 134 by using two wires, so as to receive the drive signal. Two ends of the rotor 164 are respectively connected to the base 163 and the top rod 162. The rotor 164 may also be connected to the bottom 110 of one of the first rod body 102*a* and the second rod body 102*b*. The motor 165 is connected to the base 163, and is configured to drive the rotor 164 to rotate according to the drive signal. The motor 165 may pass through the base 163 through two wires and be electrically connected to the controller 134, to receive the drive signal.

In some embodiments, the rotational connection assembly 160 further includes a bearing 166 and a connection bracket 168. The bearing 166 is pivotally disposed on the motor 165 (on the outer edge of the rotating shaft 167 of the motor 165), and the bearing 166 has two first electrodes 170. The base 163 has two second electrodes 172, and the two second electrodes 172 surround the bearing 166 and are respectively electrically connected to the two first electrodes 170. The connection bracket 168 is located between the base 163 and the rotor 164 and surrounds the motor 165. One side of the rotor 164 has an electrical connection terminal 174, and one side of the connection bracket 168 has an electrical connection socket 176. The electrical connection terminal 174 is connected to the electrical connection socket 176, and the electrical connection socket 176 is electrically connected to the two first electrodes 170, so as to drive the rotor 164 and the connection bracket 168 to rotate synchronously. The drive assembly 128, the controller 134, the first light-emitting unit 144, the second light-emitting unit 146, and the motor 165 can be connected via two wires to form a control loop. Specifically, when the motor 165 rotates according to the drive signal, the two wires can simultaneously transmit the drive signal sequentially through the two second electrodes 172, the two first electrodes 170, and the electrical connection socket 176 to the electrical connection terminal 174. The light-emitting units (144, 146) may be electrically connected to the electrical connection terminal 174 via wires to emit light according to the drive signal. Herein, the turntable assembly 106 or the light-emitting units (144, 146) in different segments of the main rod 102 can transmit the drive signal through the serial connection of the rotational connection assembly 160, so that the controller 134 can simultaneously control the vertical swing, horizontal rotation, or lighting effects of branches in different segments. In some embodiments, there may be a plurality of electrical connection sockets 176 and electrical connection terminals 174. In some embodiments, as shown in FIG. 16, the connection bracket 168 may be formed by assembling a plurality of brackets. For example, an upper bracket is provided with the electrical connection socket 176, and a lower bracket is provided with the bearing 166, to facilitate production and assembly.

In some embodiments, the rotor 164 includes a connecting sleeve 169, and the connecting sleeve 169 is sleeved on the rotating shaft 167, causing the rotating shaft 167 to drive the rotor 164 to rotate. In some embodiments, the connecting sleeve 169 further includes a guiding opening 171, and the guiding opening 171 is used for guiding the rotor 164 into the connecting sleeve 169. Specifically, the guiding opening 171 flares outward from the rotor 164, and the inclined surface of the guiding opening 171 can guide the rotor 164 to extend into the connecting sleeve 169.

In some embodiments, as shown in FIG. 1, FIG. 2, and FIG. 3, the dynamic Christmas tree 100 further includes a sensor 178. The sensor 178 is electrically connected to the controller 134. The sensor 178 is configured to generate a sensing signal when being actuated. The controller 134 may adjust the drive signal according to the sensing signal. The sensor 178 may be a distance sensor, a brightness sensor, an ultrasonic sensor, an infrared sensor, or an acoustic sensor. Taking an acoustic sensor as an example for the sensor 178, the sensor 178 may generate a first sensing signal and a second sensing signal based on a magnitude of a received acoustic wave, with the first sensing signal being greater than the second sensing signal. The controller 134 may increase the rotational speed of the turntable assembly 106 according to the first sensing signal, or decrease the rotational speed of the turntable assembly 106 according to the second sensing signal. The lighting drive chip 147 may increase the brightness or flicker frequency of the light-emitting units (144, 146) according to the first sensing signal, or decrease the brightness or flicker frequency of the light-emitting units (144, 146) according to the second sensing signal. Accordingly, when ambient sound (which may refer to background music in an environment where the dynamic Christmas tree 100 is placed) is louder (or melody is more rapid), the swing frequency of the first branch rod 104 and/or the second branch rod 116 is higher, and the brightness of the light-emitting units (144, 146) is brighter or the flicker frequency is faster. Conversely, when the ambient sound is softer (or the melody is slower), the swing frequency of the first branch rod 104 and/or the second branch rod 116 is lower, and the brightness of the light-emitting units (144, 146) is dimmer or the flicker frequency is slower. It should be noted that the controller 134 may determine an environmental change based on the magnitude of a sensed value according to the type of sensor 178 used, and thereby determine a feedback action of the dynamic Christmas tree 100. Taking the sensor 178 as an infrared sensor as an example, when the sensor 178 detects an object (which may refer to a human body or an animal) approaching, the dynamic Christmas tree 100 may increase the swing speed or enhance the lighting effect. Conversely, when the sensor 178 detects that an object (which may refer to a human body or an animal) moves away or does not detect any object, the dynamic Christmas tree 100 reduces the swing speed or lowers the lighting effect (or stops emitting light) to save power. In some embodiments, the sensor 178 may also be electrically connected to the controller 134 and the lighting drive chip 147 separately, so that the controller 134 and the lighting drive chip 147 can separately actuate the drive assembly 128, the rotational connection assembly 160, and the light-emitting units (144, 146) according to the sensing signal generated by the sensor 178.

In some embodiments, as shown in FIG. 1 and FIG. 2, The adjacent active layer 112, driven layer 120, and/or top 108 may be used as a linked combination. The dynamic Christmas tree 100 may be provided with a plurality of linked groups, and through action control of the first branch rod 104, the second branch rod 116, the rotational connection assembly 160, and the light-emitting units (144, 146), control changes and visual effects are enhanced. It should be noted that main rods 102 of different linked groups may be connected to each other. For example, a bottom end 114*b* of an upper main rod 102 may be connected to a top end 114*a* of a lower main rod 102, thereby connecting two main rods 102. A connection structure between the main rods 102 may be achieved by sleeving and fixing them together via different diameters or by using an additional sleeve for connection.

In some embodiments, as shown in the turntable 126 and the driven gear 140 of FIG. 6 or FIG. 13, the turntable 126 and the driven gear 140 may be a planetary gear set. For example, the annular tooth portion 136 of the turntable 126 may be a ring gear, and the driven gear 140 may be a sun gear.

In some implementations, as shown in FIG. 3, the dynamic Christmas tree 100 further includes a tilt sensor 180 (for example, an acceleration sensor). The tilt sensor 180 may be disposed on the main rod 102, the first branch rod 104, the second branch rod 116, the turntable assembly 106, or the rotational connection assembly 160. When the tilt sensor 180 detects that the dynamic Christmas tree 100 has tilted beyond a preset angle (for example, 30 degrees), it may generate a warning signal. The controller 134 may stop sending the drive signal according to the warning signal, causing the turntable assembly 106, the rotational connection assembly 160, and the light-emitting units (144, 146) to cease operation, thereby enhancing safety. In some embodiments, the tilt sensor 180 may alternatively be a tilt switch, and the tilt switch is used to directly cut off the power supply to the controller 134, the turntable assembly 106, and the rotational connection assembly 160 when the main rod 102 tilts.

In some embodiments, the turntable assembly 106 and the rotational connection assembly 160 may be applied to existing Christmas trees. It should be noted that the larger the Christmas tree, the more its trunk will be divided into detachable multi-segment trunks for easier assembly by the user. The turntable assembly 106 and the rotational connection assembly 160 may be separately assembled onto the trunk to form the dynamic Christmas tree 100. Because an existing Christmas tree has a height of over one meter, dividing it into a plurality of trunk segments can reduce an output torque requirement of the rotational connection assembly 160.

In some embodiments, as shown in FIG. 13, the fixed disk 124 has a first positioning point 182, and the turntable 126 has a second positioning point 184. The controller 134 is configured to: when the first positioning point 182 and the second positioning point 184 are conductive, determine that the turntable 126 is located at an initial angle. Specifically, the first positioning point 182 and the second positioning point 184 serve as origin markers. When the first positioning point 182 and the second positioning point 184 are conductive, it indicates that the turntable 126 has rotated to the initial angle, and the controller 134 can position the turntable 126 at the initial angle (motor position homing) according to the electrical signal generated by the conduction of the two contact points (182, 184). Accordingly, rotational control performed by the controller 134 on the turntable 126 can instantly calibrate the rotation angle of the turntable 126. It should be noted that when the turntable 126 is at the initial angle, the first branch rod 104 and/or the second branch rod 116 are in a freely hanging state.

In conclusion, in the dynamic Christmas tree 100 in some embodiments, rotation of the turntable assembly 106 is controlled, to directly or indirectly drive the first branch rod 104 and the second branch rod 116 to vertically swing. In this way, a swing sequence of the first branch rod 104 and the second branch rod 116 can be further controlled according to a movement stroke or a rotational speed of the turntable assembly 106. Under coordination of swinging of the branch rods (104, 116) and the lighting, a dynamic effect simulating branches being blown by the wind is created, so as to meet a user's demand for dynamic effects such as swinging and illumination of the Christmas tree. In some embodiments, different segments of the dynamic Christmas tree 100 may be connected in series via the rotational connection assembly 160. The rotational connection assembly 160 can horizontally rotate different segments of the main rod 102 (for example, the top rod 162, the first rod body 102*a*, or the second rod body 102*b*). Accordingly, different segments of the dynamic Christmas tree 100 (for example, dividing a two-meter tree height into three segments) can all perform same or different vertical swings, horizontal rotations, or lighting effects.

Certainly, the present disclosure may further have various other embodiments. A person skilled in the art may make various corresponding changes and variations according to the present disclosure without departing from the spirit and essence of the present disclosure, and these corresponding changes and variations shall fall within the protection scope of the appended claims of the present disclosure.

What is claimed is:

1. A dynamic Christmas tree, comprising:

a main rod, comprising a top and a bottom, an active layer existing between the top and the bottom;

a first branch rod, connected to the main rod and located at the active layer;

a turntable assembly, having a first actuating portion, the turntable assembly being annularly fixed to the main rod, and the first actuating portion extending toward the first branch rod;

a second branch rod, connected to the main rod and located on a driven layer between the active layer and the bottom;

a connection line, one end of which is connected to the second branch rod and the other end of which is connected to the first branch rod or the turntable assembly, and the connection line being located outside the turntable assembly, wherein the turntable assembly drives the second branch rod via the connection line; and a controller, configured to generate a drive signal, the turntable assembly being actuated according to the drive signal, wherein the turntable assembly is configured to: when being actuated, drive the first actuating portion to move around the main rod, to intermittently push the first branch rod to swing relative to the main rod, wherein the turntable assembly comprises:

a fixed disk, having a central shaft hole, the central shaft hole being annularly fixed to the main rod;

a turntable, movably connected to the fixed disk, the turntable having an upper surface and a side surface, and the first actuating portion being located on the upper surface; and a drive assembly, configured to drive, according to the drive signal, the turntable to rotate relative to the main rod.

2. The dynamic Christmas tree according to claim 1, wherein an inner edge of the side surface has an annular tooth portion, an accommodating portion is provided between the turntable and the fixed disk, and the drive assembly is disposed in the accommodating portion, and wherein the drive assembly comprises a driven gear and a motor unit, the driven gear meshes with the annular tooth portion, and the motor unit is configured to drive the driven gear according to the drive signal.

3. The dynamic Christmas tree according to claim 1, wherein the side surface has an annular tooth portion, and the drive assembly is disposed on the fixed disk, and wherein the drive assembly comprises a driven gear and a motor unit, the driven gear meshes with the annular tooth portion, and the motor unit is configured to drive the driven gear according to the drive signal.

4. The dynamic Christmas tree according to claim 1, wherein the turntable assembly further has a second actuating portion, the second actuating portion extends toward the connection line, and the first actuating portion and the second actuating portion are staggered at a peripheral position of the turntable assembly; wherein the turntable has an upper surface and a side surface, and the second actuating portion is located on the side surface.

5. The dynamic Christmas tree according to claim 4, wherein the upper surface has a first light-emitting unit, and the first light-emitting unit is configured to generate first light oriented to the top according to the drive signal; and the fixed disk has a second light-emitting unit, and the second light-emitting unit is configured to generate second light oriented to the bottom according to the drive signal.

6. The dynamic Christmas tree according to claim 2, further comprising a clasp member, two ends of the clasp member respectively having a clasp portion and an abutment portion, the clasp portion clasping the first branch rod, the abutment portion normally abutting against the upper surface, and the abutment portion being located on a moving track of the first actuating portion.

7. The dynamic Christmas tree according to claim 6, wherein the turntable assembly further comprises a top cover, the top cover covers the turntable, the top cover has a through-hole, the clasp member extends into the through-hole, and the top cover, the fixed disk, and the turntable are separated from or assembled to the main rod according to the central shaft hole.

8. The dynamic Christmas tree according to claim 2, further comprising a connecting rod disposed at the active layer, the connecting rod having a fixed segment and a movable segment, one end of the fixed segment being connected to the main rod, one end of the movable segment being pivotally connected to the other end of the fixed segment, and the first branch rod being connected to the other end of the movable segment.

9. The dynamic Christmas tree according to claim 1, further comprising:

a rotational connection assembly, one end of which is connected to the top of the main rod; and a top rod, connected to the other end of the rotational connection assembly, wherein the rotational connection assembly is configured to rotate the top rod according to the drive signal.

10. The dynamic Christmas tree according to claim 9, wherein the rotational connection assembly comprises:

a base, connected to the top of the main rod;

a rotor, one end of which is connected to the base, and the other end of which is connected to the top rod; and a motor, connected to the base and configured to drive the rotor to rotate according to the drive signal.

11. The dynamic Christmas tree according to claim 10, wherein the rotor comprises a connecting sleeve, and the connecting sleeve is sleeved on a rotating shaft of the motor, so that the rotating shaft drives the rotor to rotate; wherein the connecting sleeve further comprises a guide opening, and the guide opening is configured to guide the rotor into the connecting sleeve.

12. The dynamic Christmas tree according to claim 10, wherein the rotational connection assembly further comprises:

a bearing, pivotally disposed on the motor and having two first electrodes, two second electrodes of the base surrounding the bearing and being respectively electrically connected to the two first electrodes; and a connection bracket, located between the base and the rotor and surrounding the motor, wherein one side of the rotor has an electrical connection terminal, one side of the connection bracket has an electrical connection socket, the electrical connection terminal is connected to the electrical connection socket, and the electrical connection socket is electrically connected to the two first electrodes, so as to drive the rotor and the connection bracket to rotate synchronously.

13. The dynamic Christmas tree according to claim 12, further comprising a first light-emitting unit and a second light-emitting unit; the first light-emitting unit, the second light-emitting unit, the motor, the drive assembly, and the controller being respectively connected by two wires to form a control circuit; the first light-emitting unit and the second light-emitting unit each having a lighting drive chip, the lighting drive chip being configured to selectively drive the first light-emitting unit and the second light-emitting unit according to the drive signal.

14. The dynamic Christmas tree according to claim 1, wherein the main rod is assembled from a first rod body and a second rod body, the first rod body and the second rod body each having the active layer and the driven layer; the dynamic Christmas tree further comprising:

a rotational connection assembly, one end of which is connected to the bottom of the first rod body, and the other end of which is connected to the top of the second rod body, the rotational connection assembly being configured to rotate the first rod body according to the drive signal.

15. The dynamic Christmas tree according to claim 14, wherein the rotational connection assembly further comprises:

a base, connected to the top of the main rod;

a rotor, one end of which is connected to the base, and the other end of which is connected to the bottom of the first rod body; and a motor, connected to the base and configured to drive the rotor to rotate according to the drive signal.

16. The dynamic Christmas tree according to claim 15, wherein the rotational connection assembly further comprises:

a bearing, pivotally disposed on the motor and having two first electrodes, two second electrodes of the base surrounding the bearing and being respectively electrically connected to the two first electrodes; and a connection bracket, located between the base and the rotor and surrounding the motor, wherein one side of the rotor has an electrical connection terminal, one side of the connection bracket has an electrical connection socket, the electrical connection terminal is connected to the electrical connection socket, and the electrical connection socket is electrically connected to the two first electrodes, so as to drive the rotor and the connection bracket to rotate synchronously.

17. The dynamic Christmas tree according to claim 16, further comprising a first light-emitting unit and a second light-emitting unit; the first light-emitting unit, the second light-emitting unit, the motor, the drive assembly, and the controller being respectively connected by two wires to form a control circuit; the first light-emitting unit and the second light-emitting unit each having a lighting drive chip, the lighting drive chip being configured to selectively drive the first light-emitting unit and the second light-emitting unit according to the drive signal, wherein the dynamic Christmas tree further comprises a tilt sensor, configured to, when sensing that the main rod tilts, send a warning signal, and the controller stops sending the drive signal according to the warning signal.

18. A dynamic Christmas tree, comprising:

a main rod, comprising a top and a bottom;

a rotational connection assembly, one end of which is connected to the top of the main rod; and a top rod, connected to the other end of the rotational connection assembly, wherein the rotational connection assembly is configured to rotate the top rod according to a drive signal, wherein the rotational connection assembly further comprises:

a base, connected to the top of the main rod;

a rotor, one end of which is connected to the base, and the other end of which is connected to the top rod;

a motor, connected to the base and configured to drive the rotor to rotate according to the drive signal;

a bearing, pivotally disposed on the motor and having two first electrodes, two second electrodes of the base surrounding the bearing and being respectively electrically connected to the two first electrodes; and a connection bracket, located between the base and the rotor and surrounding the motor, and wherein one side of the rotor has an electrical connection terminal, one side of the connection bracket has an electrical connection socket, the electrical connection terminal is connected to the electrical connection socket, and the electrical connection socket is electrically connected to the two first electrodes, so as to drive the rotor and the connection bracket to rotate synchronously.

19. The dynamic Christmas tree according to claim 18, wherein the rotor comprises a connecting sleeve, and the connecting sleeve is sleeved on a rotating shaft of the motor, so that the rotating shaft drives the rotor to rotate, and wherein the connecting sleeve further comprises a guide opening, and the guide opening is configured to guide the rotor into the connecting sleeve.

20. The dynamic Christmas tree according to claim 18, further comprising:

a controller;

a first light-emitting unit; and a second light-emitting unit, wherein the controller is configured to generate the drive signal, wherein the first light-emitting unit, the second light-emitting unit, the motor, the drive assembly, and the controller is respectively connected by two wires to form a control circuit, and wherein each of the first light-emitting unit and the second light-emitting unit has a lighting drive chip, the lighting drive chip being configured to selectively drive the first light-emitting unit and the second light-emitting unit according to the drive signal.

* * * * *